US009757638B1

(12) United States Patent
Orfe

(10) Patent No.: US 9,757,638 B1
(45) Date of Patent: Sep. 12, 2017

(54) GOLF TEE AND PRACTICE BALL ASSEMBLY

(71) Applicant: Russell Orfe, Las Vegas, NV (US)

(72) Inventor: Russell Orfe, Las Vegas, NV (US)

( * ) Notice: Subject to any disclaimer, the term of this patent is extended or adjusted under 35 U.S.C. 154(b) by 0 days.

(21) Appl. No.: 15/339,556

(22) Filed: Oct. 31, 2016

(51) Int. Cl.
*A63B 69/36* (2006.01)
*A63B 69/00* (2006.01)
*A63B 57/10* (2015.01)

(52) U.S. Cl.
CPC ..... *A63B 69/0091* (2013.01); *A63B 57/10* (2015.10); *A63B 69/36* (2013.01)

(58) Field of Classification Search
CPC ..... A63B 69/0091; A63B 69/36; A63B 57/10
See application file for complete search history.

(56) References Cited

U.S. PATENT DOCUMENTS 2,219,732 A * 10/1940 Armstrong ..... A63B 57/12 473/388
2,466,115 A * 4/1949 Macinnes ..... A63B 57/10 473/392
2,509,166 A * 5/1950 Phillips ..... A63B 57/10 298/1 R
2,823,038 A * 2/1958 White ..... A63B 69/0091 473/149
4,004,814 A * 1/1977 Blair ..... A63B 57/10 473/392
4,307,888 A * 12/1981 Ohle ..... A63B 69/0091 473/429
4,429,880 A * 2/1984 Chen ..... A63B 69/0091 473/141
4,616,834 A * 10/1986 Davis ..... A63B 69/0091 473/429
5,467,978 A * 11/1995 Paluch ..... A63B 69/0079 473/429
5,472,186 A * 12/1995 Paulsen ..... A63B 69/0091 473/429
6,500,077 B1 * 12/2002 Wei ..... A63B 57/10 473/396

* cited by examiner

*Primary Examiner* — Steven Wong
(74) *Attorney, Agent, or Firm* — Thomas B. Hayes

(57) ABSTRACT

A golf practice tee and ball assembly that includes a support tee member, a support frame member, and support hitter member that can be efficiently used to practice golf swings anywhere. The support tee member includes an external base with a spiked end and an internal receiving cavity with the internal receiving cavity including an o-ring gasket. The frame member is an L-Shaped rod with a first section of the rod having a convex knob formed thereon and a second section having a mounting hole at one end and the support hitter member at the other. The support hitter member includes a mounting section with an end of the mounting section mountable to the mounting hole of the second section of the L-Shaped rod and another sectional end having an impact absorbent ball. The L-Shaped rod can be placed into the support tee member by forcing the convex knob through the o-ring of the internal receiving cavity. The mounted support hitter member and L-Shaped rod is then revolvable about the support tee member.

6 Claims, 4 Drawing Sheets

60

GOLF TEE AND PRACTICE BALL ASSEMBLY

TECHNICAL FIELD

The present invention relates to the field of practice golf tees and balls and, more particularly, to a simple practice golf tee and golf ball assembly with the assembly being able to easily couple with the golf tee and being revolvable around the golf tee.

BACKGROUND

Sporting activities and sporting events are passionate endeavors that most people enjoy partaking in and watching. Sporting activities and sporting events inspire and motivate people to want to get involved in these activities and events. As such, most people, of all ages, are involved in some kind of sporting activity or event, if not both. These activities and events are big business and serve a beneficial need. However, there are a lot of people that do not have the time, lack the desire, or money to participate in the actual activities. In addition, in today's society as society has become more technically advanced and electronically connected participation in these activities has become less common due to simulated alternatives. This is unfortunate because although participating in a sporting event has benefits, actual activity in these types of sporting activities is much more beneficial. Whether this lack of participation is due to lack of money, time, desire, or simulated alternatives, actual instruments that can inspire and motivate people to actual participate in sporting activities would be beneficial.

To further advance the argument, a person can either go to a pool hall and play billiards, buy a billiards table and play pool, use a home practice model purchased from a local retailer, such as WalMart©, or alternatively use a home computing source to play a simulated game. A person can either join a baseball or softball league and play baseball or softball, buy a batting cage, baseball bat and balls and play that way, or use a home computing source to play a simulated game. A person can either join or go to a golf club and play golf, buy a golf net and accessories and play that way, or use a home computing source to play a simulated game. Regardless, in each case, there is involved time, money, and complexity to either participate or practice the sport of choice. In the latter case, golf can be expensive but also very enjoyable and a good source of exercise. There are many options available beyond going to a golf club and playing golf or using a home computing device to simulate the experience that can be less expensive and time consuming. An alternative option is to use a golf net and accessories, or something equivalent, to practice and get exercise. However, many of the options available are either too expensive, too complex, or both. In many cases, the options available are too large and have too many parts that need assembly and disassembly, which makes them not easily manageable, transportable, and, therefore, not easily usable.

As such, there is a need for a simply, cost effective golf tee and practice ball assembly.

SUMMARY

The example embodiments presented herein meet the above-identified needs by providing a golf practice tee and ball assembly that includes a support tee member, a support frame member, and support hitter member which is compact, made from light, durable, and cost effective materials, can be easily assembled and disassembled, and when assembled can be used to practice golf swings almost anywhere.

The support tee member includes a base bottom portion, e.g. formed in a shape of a spike for spiking into turf, and an upstanding side wall portion surrounding and continuing the base bottom portion to form an internal receiving cavity with the internal receiving cavity including an o-ring securely positioned along a section of the receiving cavity. The support frame member includes a coupling rod and a mounting rod, with the rods formed together on one end at right angles. The coupling rod further includes a convex knob formed along a circumferential section of the coupling rod. The mounting rod further includes a mounting hole at an end of the mounting rod and a flange at another end of the mounting rod. The support hitter member includes a mounting section with an end of the mounting section mountable to the mounting hole of the mounting rod and another end of the support hitter member having an impact absorbent ball, e.g. made of a plastic core and a foam outer shell, shaped in the form of a golf ball. The support hitter member can be mounted to the mounting rod and the mounting rod can be placed into the support tee member by forcing the convex knob through the o-ring of the internal receiving cavity. The support hitter member is then revolvable about the support tee member.

DETAILED DESCRIPTION

Figure 1:
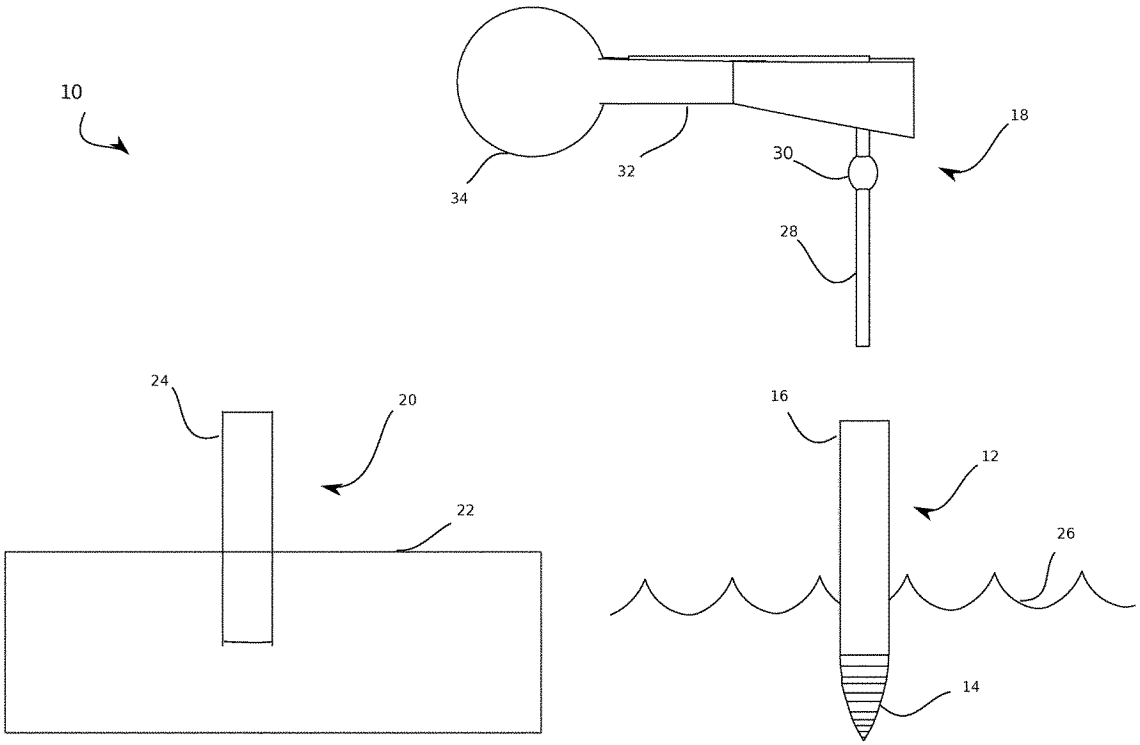
FIG. 1 is a front view of a golf tee and practice ball assembly according to first and second embodiment of the invention. In the first embodiment, the golf tee has a form that includes a spike on one end and another end that can be coupled with a practice ball assembly. In the second embodiment, the golf tee has a form that includes an anchor base on an end and another end that can be coupled with the practice ball assembly.

Referring to FIG. 1, illustrated is a front view of a golf tee and practice ball assembly according to first and second embodiments of the invention and is denoted generally as 10. In the first embodiment, the golf tee 12 has a form that includes a spike 14 on one end and another end 16 that can be coupled with a practice ball assembly 18. In the second embodiment, the golf tee 20 has a form that includes an anchor base 22 on an end and another end 24 that can be coupled with the practice ball assembly 18.

In the first embodiment, the golf tee 12 includes the spiked end 14 that can be spiked or inserted into turf 26. Once inserted into the turf 26, the other end 16 can be coupled with the practice ball assembly 18. In the second embodiment, the golf tee 20 includes the anchor base 22. The anchor base 22 can be any block of material that can stabilize the golf tee 20, e.g. a plastic block filled with sand or made of other more sturdy materials, such as a heavier metal, that would provide an adequate anchor base. In each embodiment, the golf tee 12,20 can be coupled with practice ball assembly 18. The practice ball assembly 18 includes an L-Shaped rod 28 wherein the L-Shaped rod 28 includes on an end a convex knob 30 formed thereon and on another end a section that can be fastened with a support hitter member 32. The support hitter member 32 includes an impact absorbent ball 34 shaped similar to a golf ball. Furthermore, the L-Shaped rod 28 can be coupled with the golf tee 12,20. The L-Shaped rod 28 can be coupled with the golf tee 12,20 when the L-Shaped rod 28, and specifically the convex knob 30, is pushed through a gasket, not illustrated, embedded in the golf tee 12,20. At that point, the assembled golf tee and practice ball assembly may be used to practice golf swings.

Figure 2:
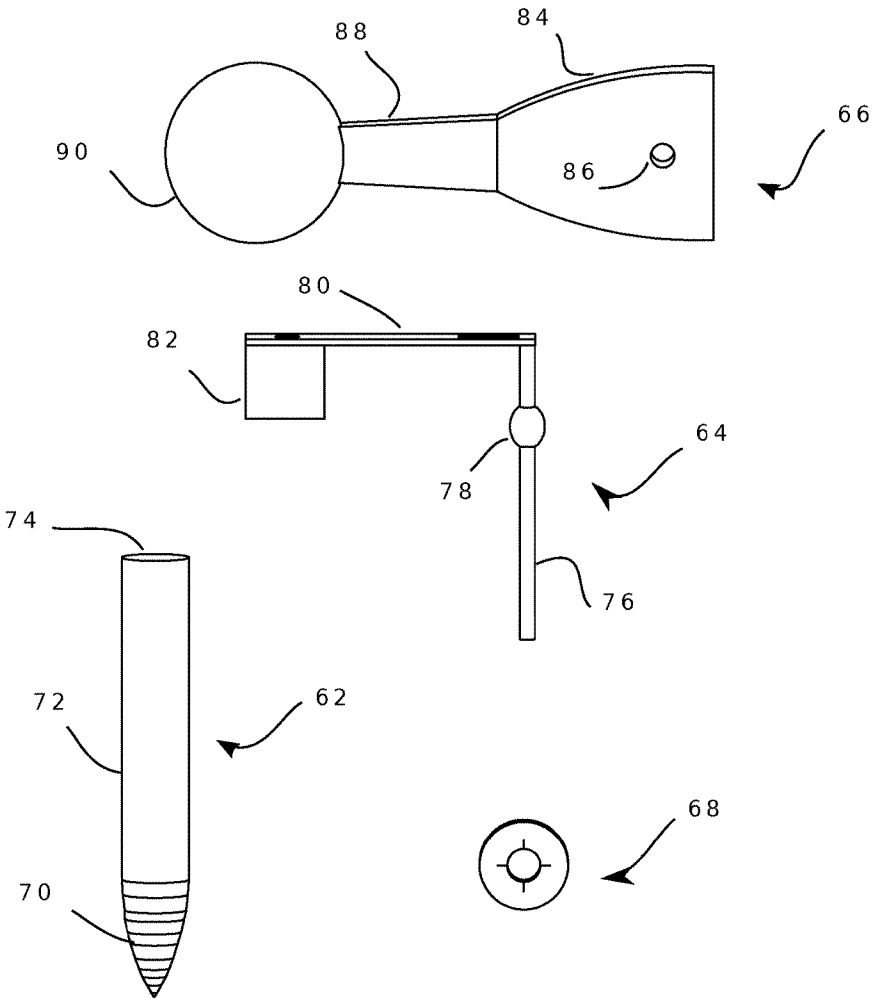
FIG. 2 is a view of component parts of the golf tee and practice ball assembly according to an embodiment of the invention.

Referring now to FIG. 2, illustrated is a view of component parts of the golf tee and practice ball assembly according to an embodiment of the invention and is denoted generally as 60. In this illustrative embodiment, the golf tee and practice ball assembly 60 comprises a support tee member 62, a support frame member 64, a support hitter member 66, and an o-ring gasket 68. The support tee member 62 includes an external base 70 with a spiked end, a sidewall portion 72, and an internal receiving cavity 74. The internal receiving cavity 74 securely houses the o-ring gasket 68. The support frame member 64 is an L-Shaped rod with a first section 76 of the rod 64 having a convex knob 78 formed thereon and a second section 80 having a mounting hole at one end and a flange 82 at another end. The support hitter member 66 includes a mounting section 84 with a mounting hole 86 on top of the mounting section 84. The mounting section 84 is mountable to the mounting hole of the second section 80 of the L-Shaped rod. The support hitter member 66 further includes another sectional end 88 with an impact absorbent ball 90 shaped in the form of a golf ball. The ball may be made of a plastic center with a foam outer layer. The impact absorbent ball helps minimize damage or wear and tear on golf clubs. The L-Shaped rod 64 can be placed into the support tee member 66 by forcing the convex knob 78 through the o-ring gasket 68 of the internal receiving cavity 74. The support hitter member 66 and L-Shaped rod is then revolvable about the support tee member.

Figure 3A:
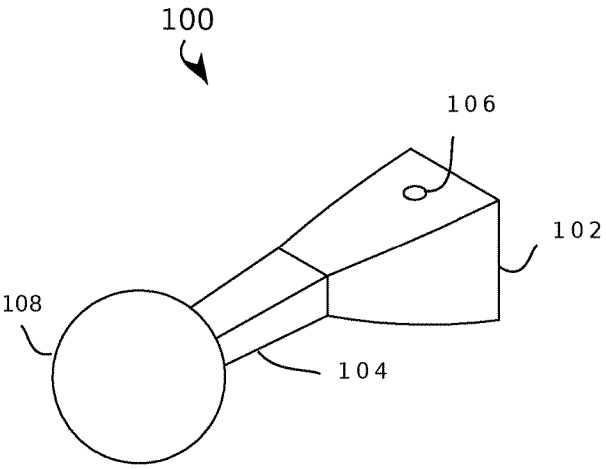
FIG. 3A is a perspective view of the hitter member according to an embodiment of the invention.

Referring now to FIG. 3A, illustrated is a perspective view of the hitter member and is denoted generally as 100. The hitter member 100 includes a first section 102 and a second section 104. The hitter member 100 includes in the first section 102 mounting hole 106 and in the second section 104 an impact absorbent ball 108. The first and second sections 102,104 may be made from plastic or metal and is shaped so that a hollow interior is present in at least the first section 102 so that the hitter member 100 can be mounted to the support frame member 64. Also, the impact absorbent ball 108 may be made of plastic or foam or a combination thereof.

Figure 3B:
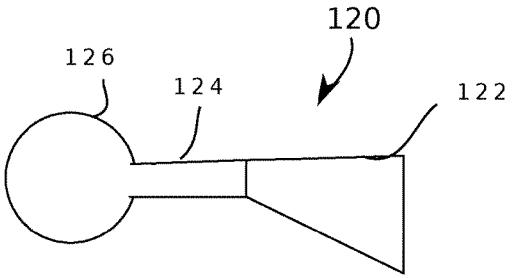
FIG. 3B is a side view of the hitter member according to an embodiment of the invention.
Figure 3C:
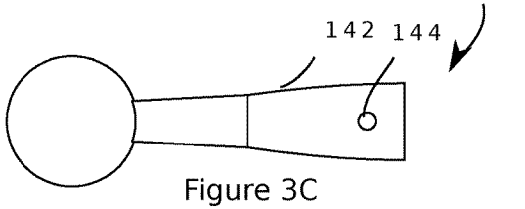
FIG. 3C is a top view of the hitter member according to an embodiment of the invention.

Referring now to FIGS. 3B and 3C, illustrated is a side view and a top view of the hitter assembly and is denoted generally as 120,140, respectively. Side view hitter assembly 120 may be a total of about 12.5 inches in length. The sidewall hitter assembly 120 includes a first sidewall section 122 that may be about 3 inches in height at its base and tappers to a second section 124 that may be about an 1.5 inches in height. Formed or mounted on the second section is a impact absorbent ball 126 that may have a diameter of about 2.5 inches. Top view hitter assembly 140 may have a top base 142 that is at one end about 1.5 inches in width with a mounting hole 144 positioned near that end.

Figure 4A:
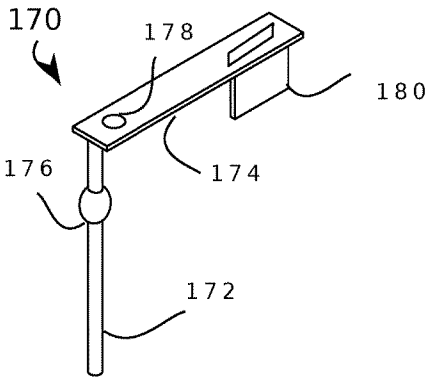
FIG. 4A is a perspective view of the support frame member according to an embodiment of the invention.

Referring now to FIG. 4A, illustrated is a perspective view of the support frame member and is denoted generally as 170. The support frame member 170 includes a coupling rod 172 and a mounting bracket 174. The coupling rod 172 includes a convex knob 176 formed thereon. The rod 172 may be made of plastic or metal. The mounting bracket 174 includes a mounting hole 178 on one end and a flange 180 on the other end, although the flange may be optional. The mounting bracket and flange may be made of plastic or metal or a combination thereof.

Figure 4B:
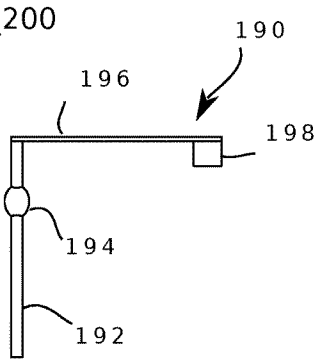
FIG. 4B is a side view of the support frame member according to an embodiment of the invention.
Figure 4C:
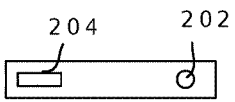
FIG. 4C is a bottom view of a section of the support frame member according to an embodiment of the invention.

Referring now to FIGS. 4B and 4C, illustrated is a side view of the support frame member and is denoted generally as 190. The support frame member 190 includes a coupling rod 192 that may be about 8 inches in length and a about ¼ inch wide round. The coupling rod 192 further includes a convex knob 194 formed thereon that may be about a ¼ inch in length and ⅜ inches in width. The support frame member 190 further includes a mounting rod 196 that includes mounting hole and flange 198. The mounting rod 196 may be about 4 inches in length and a ½ inch in width.

Referring now to FIG. 4C, illustrated is a mounting rod and is denoted generally as 200. The mounting rod 200 includes the mounting hole 202 and the flange 204, although the flange may be optional. The mounting rod may be about 4 inches in length and about ½ inch in width and the flange 204 may be about a ½ inch in height and about ½ inch in length.

Figure 5B:
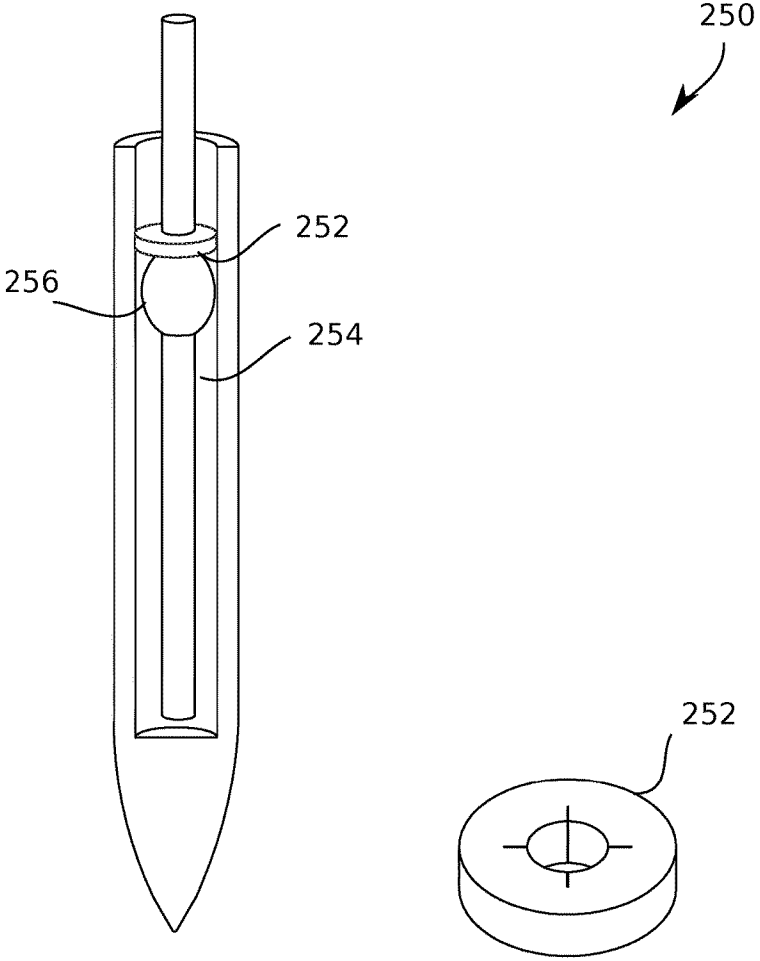
FIG. 5B is a cut away view of the golf tee and partial frame member according to an embodiment of the invention.
Figure 5A:
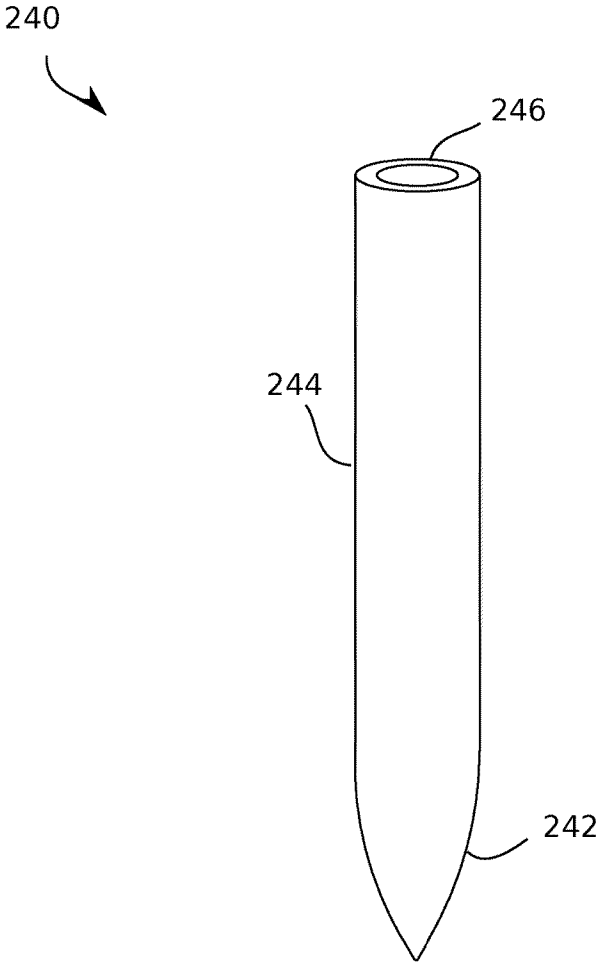
FIG. 5A is a perspective view of the golf tee according to an embodiment of the invention.

Referring now to FIG. 5A and FIG. 5B, illustrated is a perspective view of the golf tee and a cut away view of the golf tee and partial support frame member according to an embodiment of the invention and is denoted generally as 240 and 250, respectively. In FIG. 5A, golf tee 240 includes base bottom portion 242 formed into the shape of a spike and an upstanding side wall portion 244 surrounding and continuing the base bottom portion to form an internal receiving cavity 246. The base bottom portion 242 and side wall portion 244 may be about 9 inches in length and the internal receiving cavity 246 may have a width of about ⅝ inches with the hollowed section being about ⅝ inches in width. In FIG. 5B, the golf tee and partial support frame member 250 includes the internal receiving cavity for receiving the coupling rod. Positioned within the internal receiving cavity is the o-ring gasket 252 securely positioned withing the cavity 254. The coupling rod includes the convex knob 256 that can be pushed through the o-ring gasket 252 causing the coupling rod to remain in place. The o-ring gasket may be about a ¼ inch thick and ⅜ inches wide. The o-ring gasket may be made from plastic or rubber or a combination thereof. Although the description of some of the figures mentions suggested dimensions, it should be understood that these are only suggestions and other dimension sizes could be functional.

Thus, While there have been shown and described and pointed out fundamental novel features of the invention as applied to a preferred embodiment thereof, it will be under stood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same Way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

The invention claimed is:

1. A golf practice tee and ball assembly comprising:

a support tee member having a base bottom portion and an upstanding side wall portion surrounding and continuing the base bottom portion to form an internal receiving cavity with the internal receiving cavity including an o-ring securely positioned along a section of the receiving cavity;

a support frame member having a coupling rod and a mounting rod, with the rods formed together on one end at right angles, and the coupling rod including a convex knob formed along a circumferential section of the coupling rod, and the mounting rod including a mounting hole at an end of the mounting rod and a flange at another end of the mounting rod;

a support hitter member having a mounting section with an end of the mounting section mountable to the mounting hole of the mounting rod and another end of the support hitter member having an impact absorbent ball shaped in the form of a golf ball; and the support hitter member when mounted to the mounting rod and the mounting rod is placed into the support tee member by forcing the convex knob through the o-ring of the internal receiving cavity of the support frame member is revolvable about the support tee member.

2. The golf practice tee and ball assembly of claim 1 wherein the base bottom portion of the support tee member is formed in the shape of a spike.

3. The golf practice tee and ball assembly of claim 1 wherein the base bottom portion of the support tee member is formed in the shape of base plate.

4. The golf practice tee and ball assembly of claim 1 wherein the support frame member is made of metal.

5. The golf practice tee and ball assembly of claim 1 wherein the mounting section of the support hitter member is made of plastic.

6. The golf practice tee and ball assembly of claim 1 wherein the impact absorbent ball is made of a plastic center and a foam exterior.

* * * * *